United States Patent [19]

Schenker et al.

[11] 4,040,939

[45] Aug. 9, 1977

[54] LEAD DIOXIDE ELECTRODE

[75] Inventors: Barry A. Schenker, Mayfield Heights; C. Richard Franks, North Madison, both of Ohio

[73] Assignee: Diamond Shamrock Corporation, Cleveland, Ohio

[21] Appl. No.: 645,014

[22] Filed: Dec. 29, 1975

[51] Int. Cl.[2] ..... C25B 11/10; C25C 7/02

[52] U.S. Cl. ..... 204/290 F; 204/38 A; 204/57; 427/126

[58] Field of Search ..... 204/290 F (U.S. only), 204/57, 38 A, 38 B; 427/126

[56] References Cited

U.S. PATENT DOCUMENTS

| | | | |
|---|---|---|---|
| 2,631,115 | 3/1953 | Fox | 136/138 |
| 2,711,496 | 6/1955 | Ruben | 204/57 X |
| 3,207,679 | 9/1965 | Schmidt | 204/42 |
| 3,627,669 | 12/1971 | Entwisle et al. | 204/290 F |
| 3,855,084 | 12/1974 | Feigi | 204/38 R |
| 3,917,518 | 11/1975 | Franks et al. | 204/95 |
| 3,926,773 | 12/1975 | Koziol et al. | 204/290 F |

*Primary Examiner*—F.C. Edmundson
*Attorney, Agent, or Firm*—Bruce M. Winchell

[57] ABSTRACT

Disclosed is an electrode for use in electrochemical processes especially electrowinning processed wherein a valve metal substrate such as titanium carries a semiconductive intermediate coating consisting of tin and antimony oxides laid down upon the valve metal substrate in a series of layers and a top coating of lead dioxide applied by a plating process.

10 Claims, No Drawings

LEAD DIOXIDE ELECTRODE

BACKGROUND OF THE INVENTION

This invention generally relates to electrodes for use in electrochemical processes especially electrowinning processes having a valve metal substrate carrying a semiconductive intermediate coating consisting of tin and antimony oxides with a top coating consisting of lead dioxide to provide a considerably less expensive electrode while obtaining low cell voltages for given current densities. More particularly the present disclosure relates to a much improved electrode having a valve metal substrate such as titanium carrying a semiconductive intermediate coating consisting of tin and antimony oxides supplied by a series of layers of tin and antimony compounds which are applied, dried and baked to their respective oxides and a top coating consisting of lead dioxide applied by electroplating of the electrode.

Electrochemical methods of manufacture are becoming ever increasingly important to the chemical industry due to their greater ecological acceptability, potential for energy conservation, and the resultant cost reductions possible. Therefore, a great deal of research and development efforts have been applied to electrochemical processes and the hardware for these processes. One major element of the hardware aspect is the electrode itself. The object has been to provide: an electrode which will withstand the corrosive environment within an electrolytic cell; an efficient electrode for electrochemical production; and an electrode cost within the range of commercial feasibility. Only a few materials may effectively constitute an electrode especially to be used as an anode because of the susceptibility of most other substances to the intense corrosive conditions. Among these materials are: graphite, nickel, lead, lead alloy, platinum, and platinized titanium. Electrodes of this type have limited applications because of the various disadvantages such as: a lack of dimensional stability; high cost; chemical activity; contamination of the electrolyte; contamination of a cathode deposit; sensitivity to impurities; or high oxygen overvoltages. Overvoltage refers to the excess electrical potential over theoretical potential at which the desired element is discharged at the electrode surface.

The history of electrodes is replete with examples of attempts and proposals to overcome some of the problems associated with the electrode in an electrolytic cell, none of which seems to have accomplished an optimization of the desirable characteristics for an electrode to be used in an electrolytic cell. Currently, in an electrowinning process for example, the cell is operated at relatively low current densities of less than 1 ampere per square inch (155 milliamperes per square centimeter). The problem in this case is to find an electrode which will have many of the desirable characteristics listed above and additionally have a low half cell voltage at higher current densities so as to conserve a considerable amount of energy in the electrochemical process. It is know for instance that platinum is an excellent material for use in electrode to be used as an anode in an electrowinning process and satisfies many of the abovementioned characteristics. However, platinum is expensive and hence has not been found suitable for industrial use to date. Carbon and lead alloy electrodes have been generally used, but the carbon anode has the disadvantage that it greatly pollutes the electrolyte due to the fast wearing and has an increasingly higher electrical resistance which results in the increase of the half cell voltage. The higher half cell voltage causes the electrolytic cell to consume more electrical power than is desirable. The disadvantages of the lead alloy anode are that the lead dissolves in the electrolyte and the resulting solute is deposited on the cathode subsequently resulting in a decrease in the purity of the deposit obtained, and that the oxygen overvoltage becomes too high. Another disadvantage of the lead alloy anode is that the $PbO_2$ changes to a $Pb_3O_4$ which is a poor conductor. Oxygen may penetrate below this layer and flake off the film resulting in particles becoming trapped in the deposited copper on a cathode. This causes a degrading of the copper plating which is very undesirable.

It has been proposed that platinum or other precious metals be applied to a titanium substrate to retain their attractive electrical characteristics and further reduce the manufacturing costs. However, even this limited use of precious metals such as platinum which can cost in the range of about $30.00 per square foot ($323.00 per square meter) of electrode surface areas are expensive and therefore not desirable for industrial uses. It has also been proposed that the surfaces of titanium be plated electrically with platinum to which another electrical deposit either of lead dioxide or manganese dioxide be applied. The anodes with the lead dioxide coating have the disadvantage of comparatively high oxygen overvoltages and both types of coatings have high internal stresses when electrolytically deposited which are liable to be detached from the surface during commercial usage, contaminating the electrolyte and the product being deposited on the cathode surface. Thus, the current density of such anodes is limited and handling of such anodes must be done with extreme care. Another attempted improvement has been to put a layer of manganese dioxide on the surface of a titanium substrate which is relatively porous in nature and building up a number of layers of the manganses dioxide so as to present an integral coating. This yields relatively low voltages as long as the current density remains below 0.5 ampere per square inch (77.5 milliamperes per square centimeter) but as the current density is increased to near 1 ampere per square inch (165 milliamperes per square centimeter) the voltage required rises rather rapidly on this type of electrode, resulting in a considerable disadvantage at higher current densities. Therefore to date none of these proposals have met with much commercial success basically because efficiencies and cost reductions desired have not been achieved to this point.

SUMMARY OF THE INVENTION

It is therefore an object of the present invention to provide an electrode having the desired operational characteristics which can be manufactured at a cost within the range of commercial feasibility.

Another object of the present invention is to provide an improved electrode for use in an electrolytic cell which will have longer wear characteristics within the given cell environment.

These and other objects of the present invention, together with the advantages thereof over existing and prior art forms which will become apparent to those skilled in the art from the detailed disclosure of the present invention as set forth hereinbelow, are accomplished by the improvements herein described, and claimed.

It has been found that an improved electrode for use in the electrolytic cell can be made of a valve metal substrate selected from the group of aluminum, molybdenum, niobium, tantalum, titanium, tungsten, zirconium and alloys thereof; on the surface of the valve metal substrate, a semi-conductive coating of tin and antimony compounds applied and converted to their respective oxides; and on the surface of said semi-conductive intermediate coating, a top coating of lead dioxide.

DESCRIPTION OF THE PREFERRED EMBODIMENTS

The improved electrode which will overcome many of these disadvantages of the prior art consists of a valve metal substrate which carries a semi-conductive intermediate coating of tin and antimony oxides and a top coating of lead dioxide. The valve metal substrate which forms the base component of the electrode is an electro-conductive material having sufficient mechanical strength to serve as a support for the coatings and should have high resistance to corrosion when exposed to the interior environment of an electrolytic cell. Typical valve metals include aluminum, molybdenum, niobium, titanium, tungsten, zirconium and alloys thereof. A preferred valve metal, based on cost, availability and electrical and chemical properties, is titanium. The titanium substrate can be solid sheet material or foraminous in nature such as the expanded metal mesh material which has a large percentage of open area.

The semi-conductive intermediate coating of tin and antimony oxides is a tin dioxide coating that has been modified by adding portions of a suitable inorganic material, commonly referred to as a "dopent". The dopent of the present invention is an antimony compound such as $SbCl_3$ which forms an oxide when heated in an oxidizing atmosphere. Although the exact form of the antimony in the coating is not certain, it is assumed to be present as a $Sb_2O_3$ for the purpose of weight calculations. The compositions are mixtures of tin dioxide and a minor amount of antimony trioxide, the latter being present in an amount of between 0.1 and 30 weight percent, calculated on the basis of total weight percent of $SnO_2$ and $Sb_2O_3$. The preferred amount of antimony trioxide in the present invention is between 15 and 20 weight percent.

There are a number of methods for applying the semi-conductive intermediate coating of tin and antimony oxides on the surface of the valve metal substrate. Typically such coatings may be formed by first physically and/or chemically cleaning the substrate by degreasing and etching the surface in a suitable acid, e. g. oxalic or hydrochloric acid or by sandblasting; then applying a solution of appropriate thermally decomposable compounds; drying; and heating in an oxidizing atmosphere. The compounds that may be empolyed include any thermally decomposable inorganic or organic salts or esters of tin and the antimony dopent, including their alkoxides, alkoxy halides, amines, and chlorides. Typical salts include: antimony pentachloride, antimony trichloride, dibutyl tin dichloride, stanic chloride, and tin tetraethoxide. Suitable solvents include: amyl alcohol, benzene, butyl alcohol, ethyl alcohol, pentyl alcohol, propyl alcohol, toluene and otherorganic solvents as well as some inorganic solvents, such as water.

The solution of thermally decomposable compounds, containing a salt of tin and a salt of antimony, in desired proportions may be applied to a clean surface of the valve metal substrate by brushing, dipping, rolling, spraying or other suitable mechanical or chemical methods. The coating is then dried by heating at approximately 100° C. to 200° C. to evaporate the solvent. This coating is then baked at a higher temperature such as 250° C. to 800° C., in an oxidizing atmosphere to convert the tin and antimony compounds to their respective oxides. This procedure is then repeated as many times as necessary to achieve a desired coating thickness or weight appropriate for the particular electrode to be manufactured. For solid titanium sheet material the desired thickness can generally be obtained by applying 2 to 6 coats of the tin and antimony compounds. Alternatively, a desired thickness of the semi-conducting intermediate layer can be built up by applying a number of layers with drying between applications, and then baking the electrode to convert the tin and antimony compounds to their respective oxides only once at the end of a series of layering steps. This method reduces the loss of tin and antimony due to vaporization of the compounds in the baking step.

On top of this semi-conductive intermediate coating is the top coating of the electrode made of lead dioxide which can be applied by several methods such as dipping, electroplating, or spraying. The top coating can be layered in the same fashion as the semi-conductive intermediate layer by building up a thickness or weight percentage as desired for a particular electrode. The preferred method for applying the lead dioxide is by electroplating lead dioxide directly onto the coated electrode from a bath containing $Pb(NO_3)_2$. This is especially true in the case of the foraminous substrates made of titanium mesh since an electroplating process assures a complete and even coverage of the entire surface which other methods could not accomplish with such ease.

It has also been found that better life times for a given electrode can be obtained by buffing the electrode surface, after the semi-conductive intermediate coating has been applied, with a wire brush or the like just prior to electroplating onto this surface the lead dioxide top coating.

A major use of this type of electrode is expected to be in the electrode deposition of metals from aqueous solutions of metal salts, such as electrowinning of antimony, cadmium, chromium, cobalt, copper, gallium, indium, manganese, nickel, thallium, tin or zinc. Other possible uses include cathodic protection of marine equipment, electrochemical generation of electrical power, electrolysis of water and other aqueous solutions, electrolytic cleaning or pickling, electrolytic production of metals powders, electrical organic synthesis and eletroplating. Two additional particular processes for which such an electrode might be used would be for the production of chlorine and hypochlorite.

In order that those skilled in the art may more readily understand the present invention and certain preferred aspects by which it may be carried into effect, the following specific examples are afforded.

EXAMPLE I

A solution for the semi-conductive intermediate coating was prepared by mixing 30 milliliters of butyl alcohol, 5 milliliters of hydrochloric acid (HCl), 3.2 grams of antimony trichloride $SbCl_3$), and 15.1 grams of stannic chloride pentahydrate ($SnCl_4.5H_2O$). A strip of clean titanium plate was immersed in hot HCl for ½ hours to etch the surface. It was then washed with water and dried. The titanium was then coated twice by brushing with the solution described above. The surface of the plate was dried for ten minutes in an over at 140° C. after applying each coating. The titanium was then baked at 500° C. for 7 ± 1 minutes. The theoretical composition of the semi-conductive intermediate coating thus prepared was 81.7 percent $SnO_2$ and 18.3 percent antimony oxides (calculated as $Sb_2O_3$). The strip was then buffed with a wire brush until a high gloss black surface appeared. The weight of the semi-conductive intermediate coating was about 3.8 milligrams per square inch (6 grams per square meter). A 4 square inch area of this titanium plate was then coated with a layer of lead dioxide by electroplating for 20 minutes at room temperature at 0.3 ampere per square inch (46.5 milliamperes per square centimeter) in a sodium plumbate plating solution containing NaOH (80 grams per liter) and PbO (30 grams per liter).

The electrode was installed and tested as the anode in a cell containing a sodium chloride solution (280 grams NaCl per liter), maintained at a temperature of about 75° C. The test was conducted at constant current densities of 1 and 3 amperes per square inch (155 and 465 milliamperes per square centimeter) resulting in half cell potentials of 1.36 and 1.44 volts, respectively, for this anode. The electrode was then tested at 3 amperes per square inch (465 milliamperes per square centimeter) for 6½ hours in a cell containing sulfuric acid (50 grams of concentrated $H_2SO_4$ per liter) at 50° C. The test was continued an additional 40½ hours after increasing the current density to 5 amperes per square inch (775 milliamperes per square centimeter) and then an additional 80 hours after increasing the $H_2SO_4$ concentration to 98 grams per liter. At the end of this test of 127 hours the electrode was still active.

EXAMPLE 2

Two electrodes ware prepared by the method described in Example 1 except that one electrode was not buffed before applying the lead dioxide. The weights of the lead dioxide were about 0.124 grams per square inch (192 grams per square meter), unbuffed and 0.119 grams per square inch (185 grams per square meter), buffed.

The electrodes were tested by the method described in Example 1. At current densities of 0.025, 0.225, and 0.425 ampere per square inch (3.9, 35 and 66 milliamperes per square centimeter), the unbuffed electrode exhibited potentials of 1.70, 1.84 and 1.88 volts, respectively, and the buffed electrode exhibited potentials of 1.66, 1.77 and 1.795 volts, respectively.

EXAMPLE 3

An electrode was prepared by the method described in Example 1 except that on lead dioxide coating was applied. The electrode contained 5 double coats of the semi-conductive intermediate coating only.

The electrode was tested at 3 amperes per square inch (465 milliamperes per square centimeter) in a cell containing dilute sulfuric acid (25 grams of conc. $H_2SO_4$ per liter), maintained at a temperature of 50° C. A test time of 4 minutes was required to obtain a 100 percent increase of the starting voltage. This test compares very unfavorably with that in Example 1 where a lead dioxide anode had a useful lifetime in excess of 127 hours in a more concentrated sulfuric acid solution.

EXAMPLE 4

A strip of clean titanium plate was etched with HCl and then coated with five double coats of the semi-conductive intermediate coating compounds using the method described in Example 1, modified, however, by drying each coating 4 minutes at 125° C. and baking 7 minutes at 500° C.

The electrode was then coated by electroplating at a current density of 0.3 amperes per square inch (46.5 milliamperes per square centimeter) for 20 minutes at 43° C. in a bath containing $Pb(NO_3)_2$ (350 grams per liter), $Cu(NO_3)_2.3H_2O$ (4 grams per liter) and Triton X-305 (1 gram per liter) and using a copper cathode.

The electrode was tested in a cell containing dilute sulfuric acid (150 grams of conc. $H_2SO_4$ per liter), maintained at 75° C. Potentials of 1.96, 1.99 and 2.04 volts were observed at current densities of 0.5, 1 and 3 amperes per square inch (77.5, 155 and 465 milliamperes per square centimeter, respectively. When this electrode was tested at 5 amperes per square inch (775 milliamperes per square centimeter) in $H_2SO_4$ (150 grams per liter), the observed lifetime was 175 hours.

EXAMPLE 5

A strip of clean titanium plate was etched with HCl and coated with the semi-conductive intermediate compounds by the method described in Example 4. The strip was then electroplated at a current density of 0.3 ampere per square inch (46.5 milliamperes per square centimeter) for 10 minutes at 43° C. in a bath containing $Pb(NO_3)_2$ (350 grams per liter), $Cu(NO_3)_2.3H_2O$ (8 grams per liter) and Triton X-305 (1 gram per liter) and using a copper cathode.

The electrode was tested as described in Example 4. Potentials of 1.95, 1.99 and 2.04 volts were observed at current densities of 0.5, 1 and 3 amperes per square inch (77.5, 155 and 465 milliamperes per square centimeter), respectively. This electrode had a lifetime of 181 hours when tested at 5 amperes per square inch (775 milliamperes per square centimeter) in $H_2SO_4$ (150 grams per liter).

EXAMPLE 6

An alkoxyl-tin solution was prepared by boiling at reflux conditions for 12 hours a mixture of 216.8 grams of anhydrous stannic chloride, 795 grams of n-amyl alcohol and 5.8 grams of water. To 11.6 grams of the above solution, 0.25 gram of antimony trichloride was added and dissolved.

Three strips of clean titanium plate were etched with HCl and coated with five double layers of the semi-conductive intermediate compounds as described above.

These strips were placed in the sodium plumbate solution described in Example 1 and electroplated at a current density of 0.75 ampere per square inch (11.6 milliamperes per square centimeter) for 30 minutes (strips No. 1 and No. 2) or for 60 minutes (strip No. 3).

Lifetime tests on these strips were made by the method described in Example 4. The observed lifetimes on strips No. 1, 2 and 3 were 110 hours, 118 hours, 110 hours, respectively.

Thus it should be apparent from the foregoing description of the preferred embodiment that the electrode composition hereindescribed accomplishes the objects of the invention and solves the problems attendent to such electrode compositions for use in electrolytic cells for electrochemical productions.

What is claimed is:

1. An electrode for use in an electrolytic process comprising: a valve metal substrate selected from the group of aluminum, molybdenum, niobium, tantalum, titanium, tungsten, zirconium, and alloys thereof; on the surface of said valve metal substrate, a semi-conductive intermediate coating consisting essentially of tin and antimony compounds applied and converted to their respective oxides such that said semi-conductive intermediate coating attains a weight greater than 2 grams per square meter of said valve metal substrate surface area; and on the surface of said semi-conductive intermediate coating, a top coating consisting essentially of lead dioxide such that said top coating attains a weight greater than 25 grams per square meter of the surface of the electrode.

2. An electrode according to claim 1 wherein said valve metal substrate is titanium.

3. An electrode according to claim 1 wherein said semi-conductive intermediate coating of tin and antimony compounds has between 0.1 and 30 weight percent of antimony compounds.

4. An electrode according to claim 3 wherein said semi-conductive intermediate coating of tin and antimony compounds has an amount of antimony compounds within the preferred range of 15 to 20 weight percent.

5. An electrode according to claim 1 wherein said weight of said semi-conductive intermediate coating of tin and antimony compounds is in the range of 6 to 30 grams per square meter of the surface area of the electrode.

6. A method for the manufacture of an electrode for use in an electrolytic process comprising the steps of: selecting a valve metal substrate from the group of aluminum, molybdenum, niobium, tantalum, titanium, tungsten, zirconium or alloys thereof: applying to the surface of the valve metal substrate two to ten coats of a semi-conductive intermediate coating consisting essentially of thermally decomposable compounds of tin and antimony containing 1.0 to 30 weight percent antimony compounds to attain a weight greater than 2 grams per square meter of the valve metal substrate surface area; drying the semi-conductive intermediate coating at a temperature in the range of 100° to 200° C; baking the semi-conductive intermediate coating in an oxidizing atmosphere at an elevated temperature in the range of 250° to 800° C to transform the tin and antimony compounds to their respective oxides; and applying on the surface of the semi-conductive intermediate coating a top coating consisting essentially of lead dioxide weighing more than 25 grams per square meter of the valve metal substrate surface area.

7. A method according to claim 6 wherein said semi-conductive intermediate coating is applied in a series of layers, each being dried before subsequent application of the next layer, and being baked at the conclusion of successive applications to their respective oxides.

8. A method according to claim 6 wherein said top coating of lead dioxide is applied by electroplating lead dioxide upon the surface of said semi-conductive intermediate coating.

9. A method according to claim 6 wherein said top coating of lead dioxide is applied by electroplating in a bath containing lead nitrate until the thickness of said outer coating is in the range of 100 to 300 grams per meter of electrode surface.

10. A method according to claim 6 comprising the additional step of buffing the surface of said semi-conductive intermediate coating prior to electroplating said top coating thereon.

* * * * *